US007654792B2

(12) United States Patent
Kikuichi et al.

(10) Patent No.: US 7,654,792 B2
(45) Date of Patent: Feb. 2, 2010

(54) BLOWER

(75) Inventors: Takahiro Kikuichi, Kyoto (JP); Masayuki Yamada, Kyoto (JP)

(73) Assignee: Nidec Corporation, Kyoto (JP)

( * ) Notice: Subject to any disclaimer, the term of this patent is extended or adjusted under 35 U.S.C. 154(b) by 0 days.

(21) Appl. No.: 10/908,582

(22) Filed: May 18, 2005

(65) Prior Publication Data

US 2005/0260065 A1 Nov. 24, 2005

(30) Foreign Application Priority Data

May 18, 2004 (JP) ..... 2004-147661
May 9, 2005 (JP) ..... 2005-135624

(51) Int. Cl.
*F01D 13/00* (2006.01)

(52) U.S. Cl. ..... 415/68; 415/199.4; 415/214.1

(58) Field of Classification Search ..... 415/66, 415/68, 198.1, 199.4, 208.1, 211.2, 213.1, 415/214.1
See application file for complete search history.

(56) References Cited

U.S. PATENT DOCUMENTS 5,484,262 A 1/1996 Thomas et al. ..... 415/178
5,498,130 A * 3/1996 Wakley et al. ..... 415/213.1
6,067,227 A * 5/2000 Katsui et al. ..... 361/695
6,071,078 A * 6/2000 Schlegel et al. ..... 416/247 R
6,343,014 B1 1/2002 Lin ..... 361/697
6,508,621 B1 * 1/2003 Zeighami et al. ..... 415/119
6,547,540 B1 4/2003 Horng et al. ..... 417/423.14
6,612,817 B2 * 9/2003 Lin et al. ..... 417/423.5
6,663,342 B2 12/2003 Huang et al. ..... 415/121.2
7,031,157 B2 * 4/2006 Horng et al. ..... 361/695
7,156,611 B2 * 1/2007 Oosawa et al. ..... 415/68
2004/0033135 A1 * 2/2004 Chang ..... 415/220

* cited by examiner

*Primary Examiner*—Edward Look
*Assistant Examiner*—Nathaniel Wiehe
(74) *Attorney, Agent, or Firm*—Keating & Bennett, LLP

(57) ABSTRACT

Blower made up of at least two axially stacked, interlocking fans. Each fan is enclosed in a housing the axially opposite ends of which are flanged. Opposing flats on immediately neighboring flanges are formed with complementary twist-locking features. The twist-locking features are configured in such a way that when the fans are stacked, the opposing flats will not be in contact with each other unless the housings are twisted out of axial alignment to bring the opposing flats flush together, and such that with the opposing flats flush in contact, twisting the housings back into axial alignment locks them together.

20 Claims, 5 Drawing Sheets

BLOWER

BACKGROUND OF THE INVENTION

1. Field of the Invention

This invention relates to a blower having a plurality of fans connected or engaged each other in a rotational axis direction.

2. Description of the Related Art

In order to improve a capacity of air flow and a static pressure generated by a fan without increasing its impeller's diameter, a blower called "a double fan" is widely used in which a plurality of axial fans are arranged along the rotational axis thereof.

In a conventional blower having a plurality of fan impellers, two or more impellers are encased in a single housing or each impeller is encased in each housing, and the housings are connected with each adjoining housing in rotational axis direction. Generally, a large amount of development cost is required to design a new blower including a design of its housing, therefore one way for realizing cost reduction is to connect or engage a plurality of existing axial fans or centrifugal fans in rotational axis direction, which meets a performance requested for the new blower.

There are two major ways to connect or engage two or more adjoining housings. One way is that flanges of the housings are fixedly coupled to each other by screws and the other is that elastic hooks formed on one housing are engaged with the recesses of the other housing.

In the case where the fans are fixedly connected by screws, however, special tool such as screwdriver or wrench may be required. This increases the number of steps for connecting the blowers as well as the number of parts of the blower, thereby the cost for producing the blower may increases because of its complex structure of the blower.

In connecting the adjoining fans by elastic hooks, on the other hand, since the elastic hooks can be formed at the same time as the housing is formed by a molding process, the cost for the housing with such elastic hooks may not increase. Also, the elastic hooks can be engaged very simply without increasing the number of steps for engaging.

However, when the connection by means of the elastic hooks is performed, there are two requirements contradicting each other. One requirement is for securing a sufficient elasticity caused by elastic deformation which may be required for completing the engaging step to make the two adjoining fans engage and the other requirement is for a sufficient engaging force. Specifically, in the case where the elasticity of the elastic hooks is increased to realize an easier engaging step, the engaging force decreases and the insufficient engaging force would be realized. On the other hand, in the case where the elasticity of the elastic hooks is decreased, the engaging force increases and the engaging step would not be accomplished, because the elastic hooks may be damaged or the housing may be warped.

BRIEF SUMMARY OF THE INVENTION

According to one aspect of the invention, there is provided a blower comprising two fans which are connected or engaged in a rotational axis direction. Each fan has a housing, at each area opposed upper or lower sides of adjoining two housing, the lower side of the upper housing and the upper side of the lower housing has flat housing portions. And two fans of the blower are held as the manner that two adjoining housings are located in parallel each other while being turned in a predetermined rotational angle around the rotational axis of the impeller, for making contact the flat housing portions of the opposed housings each other. On, near or in separate area from the flat housing portions, upper and lower housing engaging portions are formed, respectively. When decreasing the rotational angle from the predetermined rotational angle, the engaging portions come to be engaged each other, so that the two flat housing portions are fixedly contacting and not separated from each other in the rotational axis of the impeller. Further, upper and lower housing stoppers are formed on the opposed surfaces of the two adjoining housings. When the rotational angle is decreased and the rotational angle come to zero, the lower housing stopper comes into contact with the upper housing stopper. In this situation, the two adjoining housings have a continuous contour aligned with each other, having a contour shape such as single rectangular parallelepiped. As a result, the upper and lower housings are fixed with each other. This structure can be used also in a combination of a housing having a fan and a housing having a stationary vane built therein. Especially in the case where an axial fan is used, the cylindrical ends of each housing are open and have little space to form such engaging parts mentioned above, therefore it may be preferable that such engaging parts should be formed at flange portions which is formed at each of four corners in rectangular shape of the housing.

Additionally, in the upper and lower housing engaging portions said above, axial recesses and axial protrusions can be formed in opposed location to make the engagement of the two adjoining housing be fastened each other. In this way, the housings can be firmly fixed in a way that each of the two adjoining housings cannot be separated in the rotational axis of the impeller.

DETAILED DESCRIPTION OF THE INVENTION

Figures 1A, 1B, 1C:
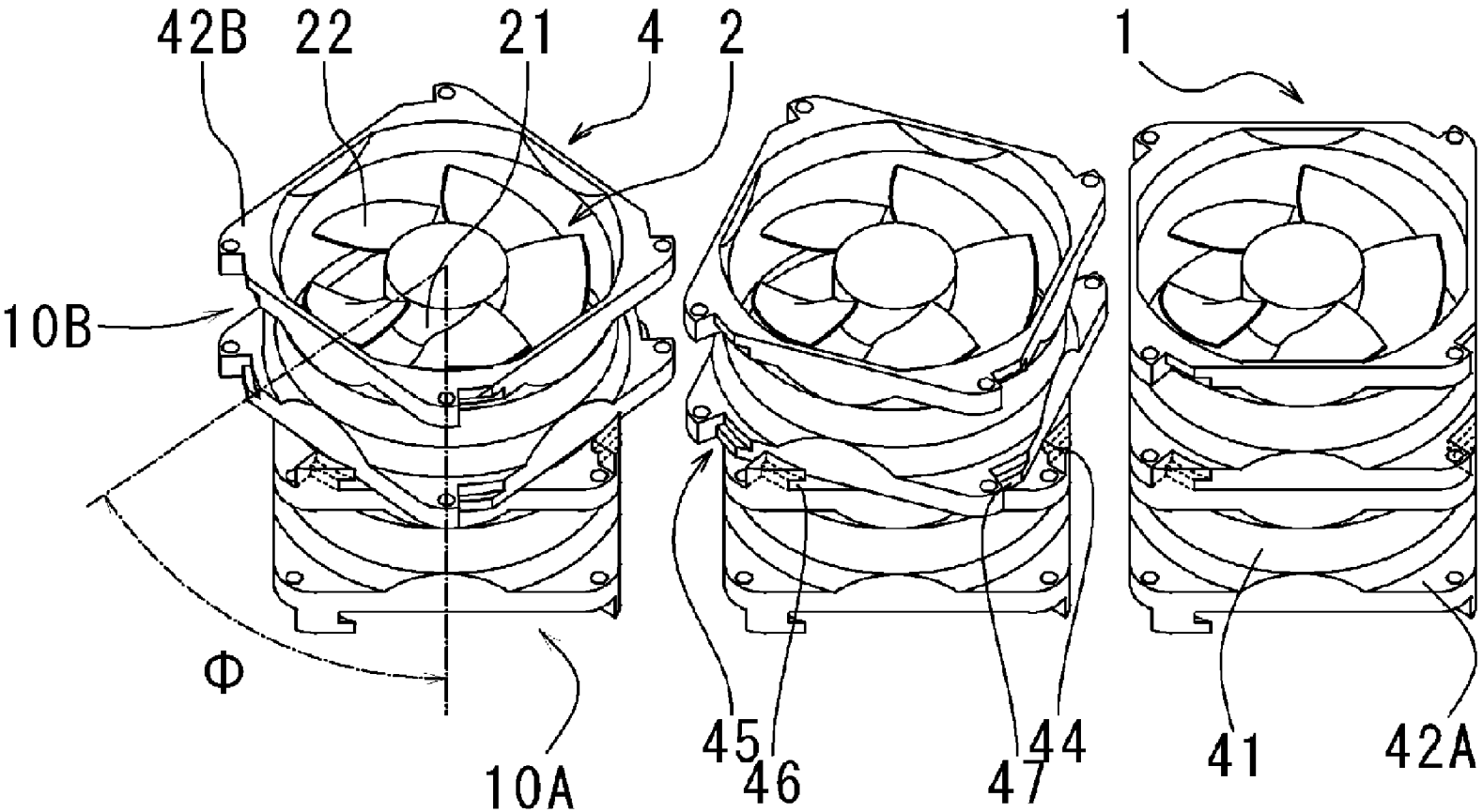
FIG. 1 is perspective views showing a blower according to a first embodiment of the invention.

An embodiment of the invention is explained below with reference to the drawings.

In the description of an embodiment that follows, each of the four directions is indicated as viewed on the drawings unless otherwise specified, and not specifically limited in embodying the invention. Also, the uppercases suffixes A and B attached to the reference numerals in the description and drawings designate the component parts of the axial fans 10A, 110A, 10B, respectively. The uppercase suffix C attached to the reference numerals in the drawings, on the other hand, designates the component parts of the stationary vane fans 11C, 111C. The component parts carrying no uppercase suffix designate common or independent parts having similar functions.

First Embodiment

Figure 2A:
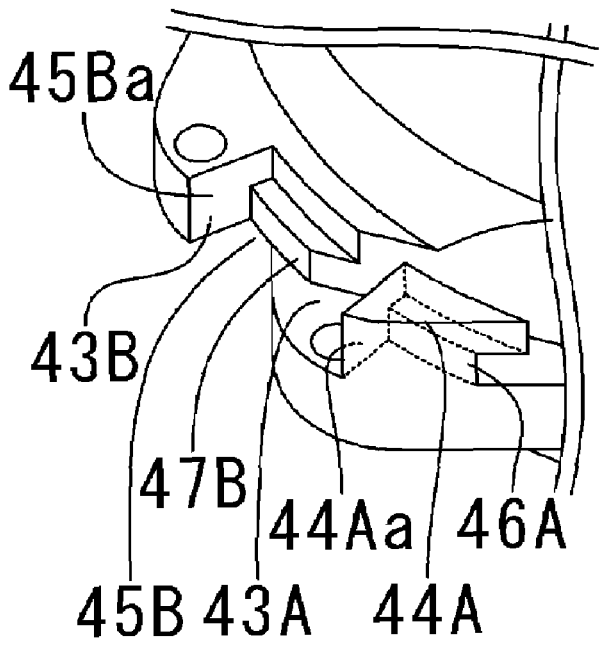
FIG. 2 is perspective views showing only the essential parts of the blower including the engaging portions of the fans according to the first embodiment of the invention.

FIG. 1 is perspective views showing a blower according to a first embodiment of the invention. Specifically, FIG. 1C designates an assembly completed by coupling two axial fans 10A, 10B, and FIG. 1A, FIG. 1B the states before being coupled. FIG. 2 is enlarged views of the engaging portion of each fan constituting the essential parts of the blower according to the first embodiment of the invention. FIG. 3 is top plan views of the blower shown in FIG. 1.

(1-1) Blower Configuration

Referring to FIG. 1, the blower 1 is configured of two axial fans 10A, 10B serially coupled to each other in the direction of the rotational axis.

The axial fans 10 each include a cylindrical peripheral wall 21 and an impeller 2 consisted by a plurality of blades 22 regularly arranged on the outer peripheral surface of the peripheral wall 21.

Also, the axial fans 10 each include a housing 4 with a cylindrical portion 41 having a cylindrical inner peripheral surface 41*a* larger in diameter than the radial outer edge of the blades 22 and concentric with the rotational axis of the impeller 2.

Further, an electric motor (not shown) to rotate the impeller 2 relatively to the housing 4 is held on the housing 4. The electric motor is a DC brushless motor including a shaft fixed at the rotational center of the impeller 2, a bearing for rotatably supporting the shaft, a bearing holder supporting the bearing on the housing 4, a stator including a plurality of coils fixed on the outer periphery of the bearing holder, and a rotor magnet fitted on the inner peripheral surface of the cylindrical peripheral wall 21 of the impeller 2.

The axial fans 10 can be used independently of each other. According to this embodiment, the lower axial fan 10A arranged on the axially lower side is combined with the upper axial fan 10B arranged on the axially upper side.

(1-2) Housing of Axial Fans

The ends of the cylindrical portion 41 of the axial fan 10A are open in axial direction, and a plurality of flanges 42 are formed radially outward of at least the end of the cylindrical portion 41 in opposed relation to the axial fan 10B. The flanges 42 are arranged in four directions at 90° intervals around the center axis of the cylindrical portion 41. The edges of the flanges 42 are formed at 90° so that the flanges 42 as a whole substantially assume the shape of a square. The axial fans 10A and 10B, when arranged serially along the axis, have the flanges 42A and 42B aligned with each other in axial direction.

By forming the flanges 42A, 42B of the axial fans 10A, 10B in the same shape as shown in FIG. 3, the blower 1 can be shaped in the same planar form as the axial fans 10A, 10B.

Before combining the axial fans 10A, 10B, the rotational axis of the impeller is displaced by angle $\phi$ from the center axis of the impeller. Also, the angle is defined as zero in the case where the axial fan 10A is rotated with the contour thereof into alignment with that of the axial fan 10B, i.e. in the case where the axial fans 10A, 10B share the same planar form.

(1-3) Flanges

In FIG. 2, that surface of the flanges 42A of the axial fan 10A which is in contact with the flanges 42B of the axial fan 10B forms a flat housing portion 43A perpendicular to the rotational axis of the impeller 2A. In similar fashion, that surface of the flanges 42B of the axial fan 10B which is in contact with the flanges 42A of the axial fan 10A forms a flat housing proton 43B perpendicular to the rotational axis of the impeller 2B. The flat housing portion 43A of the axial fan 10A and the flat housing portion 43B of the axial fan 10B are in slidable contact with each other, and function as a housing engaging portion and a housing stopper, respectively.

Each flange 42A has a protrusion 44A providing the housing stopper on the flat housing portion 43B side thereof in opposed relation to the flat housing portion 43A. The protrusion 44A is formed with a radial recess 46A providing a housing engaging portion. Also, each flange 42B is formed with a notch 45B cut off from the flat housing portion 43B providing a stopper corresponding to the protrusion 44A. Further, the notch 45B is formed with a radial protrusion 47B providing an housing engaging portion in such a shape as to engage the radial recess 46A closely.

The protrusion 44A and the notch 45B are so shaped as to complement each other. Once the flat housing portion 43A and the flat housing portion 43B are rotationally slid to reduce the angle $\phi$ around the rotational axis of the impeller to zero, therefore, the radial protrusions 47B are fitted, under light pressure, into the radial recesses 46A located at four points, respectively, so that each notch 45B and the corresponding protrusion 44A are fitted closely with each other.

More specifically, each protrusion 44A is formed with the radial recess 46A along the peripheral direction around the rotational axis. In the radial recess 46A, the protrusion 44A is cut off by one half of the height of the protruded portion from the flat housing portion 43A, and the peripheral and inner ends thereof are open. The protrusion 44A has the same height as the thickness of the flange 42. Each notch 45B is cut off in the same shape as the protrusion 44A including the flat housing portion 43B. Further, the radial protrusion 47B in the shape corresponding to the radial recess 46A is formed around the rotational axis inside the notch 45B. The radial protrusion 47B is one half as thick as the flange 42B, and has the same radial thickness as the radial recess 46A. The height and the radial thickness of the radial recess 46A are equal to or slightly smaller than the thickness and the radial thickness, respectively, of the radial protrusion 47B.

The engagement between the radial recess 46A and the radial protrusion 47B providing the engaging portions restricts the axial movement of the axial fans 10A, 10B. Also, the friction generated by the contact between the protrusion 44A including the radial recess 46A and the notch 45B including the radial protrusion 47B restricts the peripheral movement of the axial fans 10A, 10B. Further, the flat surface 44Aa providing a lower flat stopper surface formed at right angles to the peripheral direction of the protrusion 44A and the flat housing portion 43A comes into contact with the flat surface 45Ba providing an upper flat stopper surface formed at right angles to the peripheral direction of the notch 45B and the flat housing portion 43B, so that the axial fans 10A, 10B are peripherally set in position.

The steps of fitting the axial fans 10A, 10B are described below.

Figures 3A, 3B, 3C:
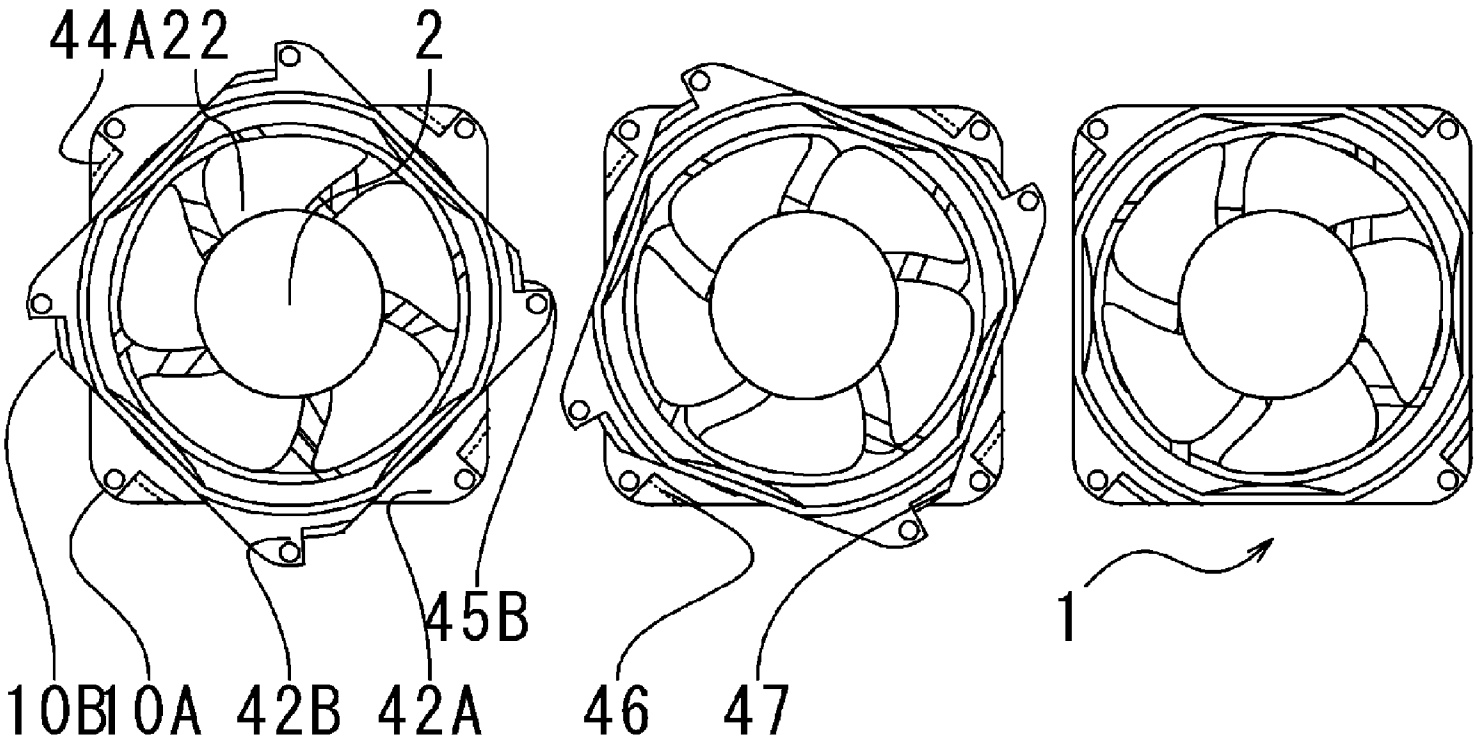
FIG. 3 is plan views showing a blower according to the first embodiment of the invention.

First, as shown in FIGS. 1A and 3A, the flat housing portion 43A of each flange 42A of the axial fan 10A and the corresponding flat housing portion 43B of the flange 42B of the axial fan 10B are brought into contact with each other. Next, the axial fan 10B is rotated counterclockwise, as taken in the plan view of FIG. 3, around the rotational axis of the impeller with respect to the axial fan 10A. As a result of this process, the radial protrusion 47B is fitted in the corresponding radial recess 46A. Finally, the axial fan 10B is rotationally slid until the flat surface 44Aa and the flat surface 45Ba come into contact with each other. As a result of this process, as shown in FIGS. 1C and 3C, the flanges 42A and 42B come into alignment with each other thereby to complete the blower 1.

The axial fans 10A, 10B are peripherally set in position by the contact between the flat surface 44Aa of the protrusion 44A and the flat surface 45Ba of the notch 45B and the resulting restriction of rotation of the axial fan 10A with respect to the axial fan 10B.

Incidentally, the radial protrusion 47A may be formed on the protrusion 44A. In such a case, however, the radial recess 46B is formed in the notch 45B.

(1-4) Miscellaneous

According to this embodiment, even after assembling the axial fan 10A on the axial fan 10B, the assembly can be disassembled by being rotationally slid in the opposite direction (clockwise) to the fitting direction. In other words, the axial fans 10A, 10B can be used independently of each other. As a result, the axial fans 10A, 10B each can be used as a standard axial fan, and without any design change, assembled into and used as the blower 1.

Figures 5A, 5B:
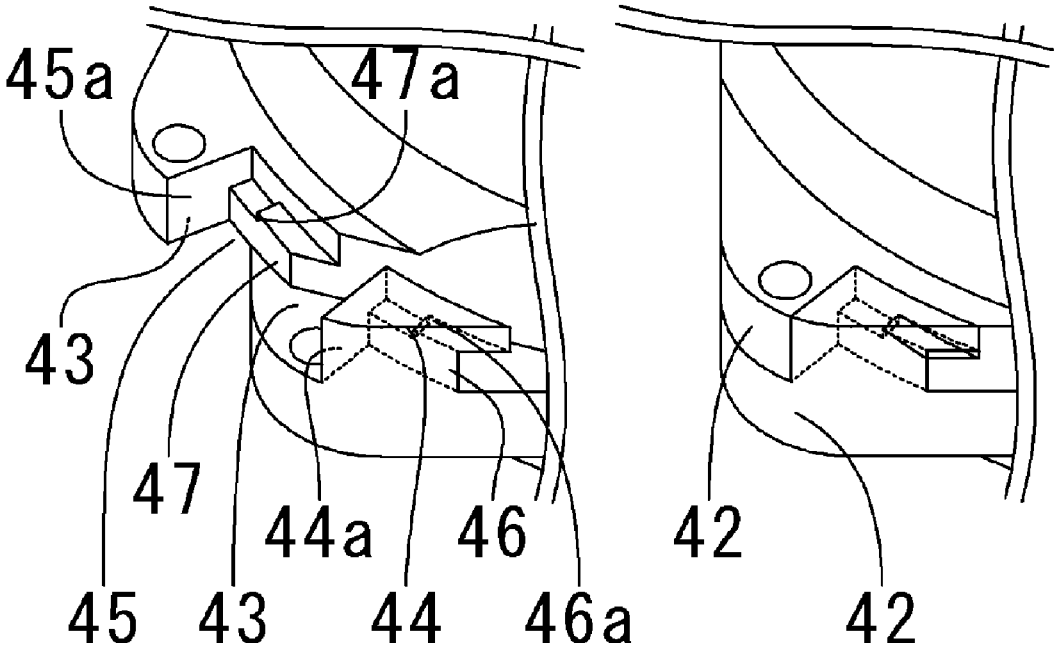
FIG. 5 is perspective views showing only the essential parts of the blower including the engaging portions of the fans according to the second embodiment of the invention.

Also, as shown in FIG. 5, an axial protrusion 47*a* that formed a tapered step may be formed in peripheral direction on each radial protrusion 47 in an axial recess 46*a* that formed a tapered accommodation portion of the radial recess 46 in peripheral direction to accommodate the step 47*a*. This structure is conveniently used in the case where the axial fans 10A, 10B, once engaged with each other, are not required to be disassembled.

The axial fans 10A, 10B, if not required to be disassembled after mutual engagement and thus to be coupled more strongly, may be fixed with an adhesive. The use of an adhesive increases the fastening force on the one hand and can cut off the vibrations between the housings at the same time.

To fix the axial fans 10A, 10B with special strength, the welding or screwing or the pressure bonding or fitting with a separate material may be used instead of the adhesive.

Also, the axial fan 10A and the axial fan 10B may have different characteristics such as the air capacity, static pressure, axial thickness, diameter of the impeller 2 or the rotational speed of the impeller 2.

Further, the blower 1 may be configured of three or more axial fans 10 arranged in axial direction. In the case where a number of axial fans 10 make up the blower 1, the fixing structure with its fixing ease according to this embodiment further enhances the advantage of the invention that the workability is improved.

Further, the provision of the protrusion 44 on the flange 42 of one axial fan 10 in axial direction and the provision of the notch 45 on the flange 42 of the other axial fan 10 makes it possible to couple the axial fans 10 using a single type of the housing 4. Thus, mass production is made possible for a reduced production cost.

Also, the axial fans 10 according to this embodiment are better arranged in such a manner that the impellers of axially adjacent axial fans 10 are rotated in opposite directions while blowing the air in the same axial direction. By doing so, both the static pressure and the air capacity of the blower 1 are improved.

Figure 2B:
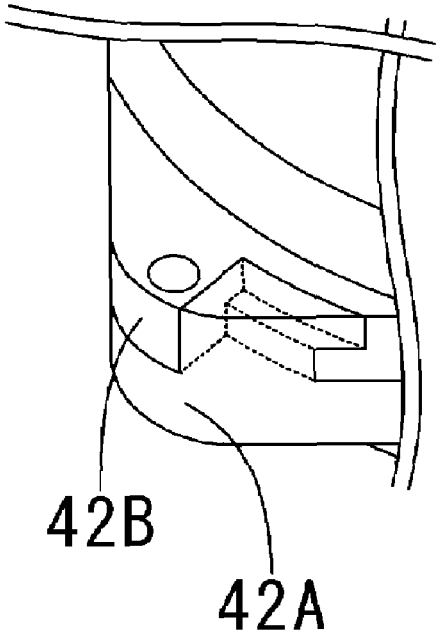

As described above, in the blower 1 according to this embodiment, the flat housing portions 43A, 43B of the axial fans 10A, 10B are rotated in sliding contact with each other, and therefore the axial fans 10A, 10B can be coupled to each other with a simple operation. In addition, the axial fans 10A, 10B are coupled completely with each other by the engagement between the protrusion 44 and the notch 45 and the friction between the flat housing portions 43 in contact with each other. Thus, the stress acting on the protrusion 44 and the notch 45 is distributed and an excessive load is prevented from being imposed on the flanges 42. As a result, the housing 4 is protected from damage or curving. Also, in view of the fact that the protrusion 44 and the notch 45, as shown in FIG. 2B, engage each other without being displaced outward or forming a gap, no air leaks from between the housings 4 to deteriorate the blowing characteristics.

Second Embodiment

Figure 4A:
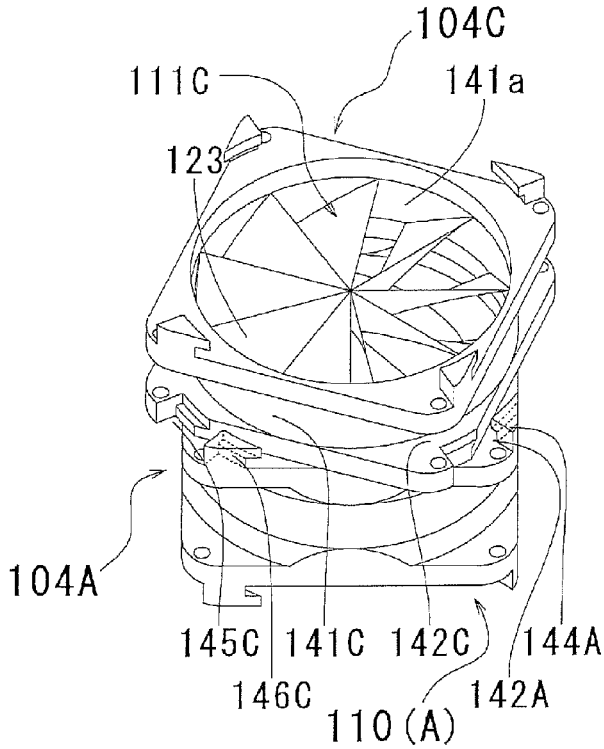
FIG. 4 is perspective views showing a blower according to a second embodiment of the invention.
Figure 4B:
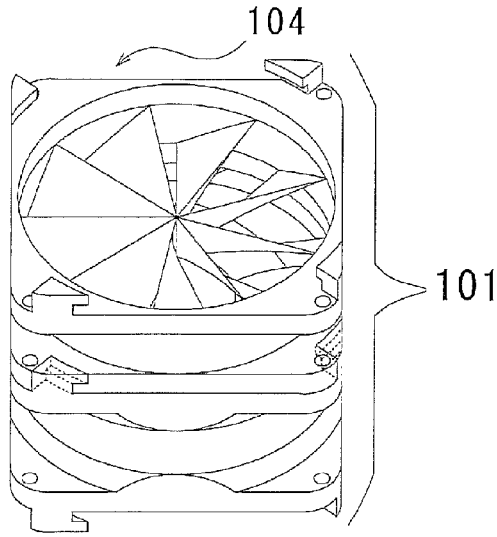

FIG. 4 is perspective views showing a blower according to a second embodiment of the invention.

(2-1) Blower Configuration

The blower 101 according to this embodiment is configured of an axial fan 110 having a similar structure as the axial fan 10 according to the first embodiment and a stationary vane 111 having fixed blades 123 which are combined serially in the direction of the rotational axis. The stationary vane 111 includes a plurality of fixed blades 123 regularly arranged on the circumference and a housing 104 having a cylindrical portion 141 for fixing the outer peripheral ends of the fixed blades 123.

With this configuration, the static pressure characteristic of the axial fan 110 can be improved. In addition, the use of a plurality of the axial fans 110 in combination can further improve the performance of the blower 101.

(2-2) Housing

The housing 104C of the stationary vane 111C, like the housing 104A of the axial fan 110A, has a plurality of flanges 142C. The flanges 142C each have a similar shape to the flanges 142A of the axial fan 110A. In this way, the stationary vane 111C and the axial fan 110A are arranged serially along the direction of the rotational axis in such a manner that the flanges 142A and 142C align with each other.

(2-3) Flanges

The surface of the flanges 142C of the stationary vane 111C which is in contact with the flanges 142A of the axial fan 110A forms a flat housing portion 143C perpendicular to the rotational axis. By doing so, the flat housing portions 143A and 143C are slidable with each other.

The flanges 142C of the stationary vane 111C each have a notch 145C. The protrusion 144 and the notch 145 are so shaped as to complement each other. The protrusion 144 is formed with a radial recess 146 along the periphery around the rotational axis. Also, the notch 145 is formed with a radial protrusion 147 in the shape corresponding to the radial recess 146 around the rotational axis.

As an alternative, the protrusion 144 may be formed with the radial protrusion 147 and the notch 145 with the radial recess 146.

The flat housing portion 143C formed on each flange 142C of the stationary vane 111C and the flat housing portion 143A formed on each flange 142A of the axial fan 110A are brought into contact with each other and rotated around the rotational axis. Then, the radial protrusion 147A is inserted in the radial recess 146C.

As an alternative, according to this embodiment, the notch 145C may be formed on each flange 142C of the stationary vane 111C and the notch 144A on each flange 142A of the axial fan 110A. As another alternative, the notch 145C may be formed on each flange 142C of the stationary vane 111C, and the protrusion 144C may be formed on the corresponding flange 142C along the rotational axis.

(2-4) Miscellaneous

Also, the blower 101 may be configured of at least one axial fan 110 and at least one stationary vane 111. In this case, the protrusion 144 and the notch 145 may be formed on each component made up of an assembly of several stationary vanes 111 and axial fans 110. By doing so, the assembly time can be reduced. Also, in the case where the blower 101 includes a number of stationary vanes 111 and axial fans 110, the use of the fixed structure according to this embodiment and the resulting fixing ease further improves the effects of the invention including the workability.

The axial fans 110 are preferably arranged in such a manner as to discharge the air in the same direction along the rotational axis of the impeller. The insertion of the stationary vane 111 between the two axial fans 110 improves the characteristics of both air capacity and static pressure. Also, the static pressure characteristic is improved more preferably by arranging the impellers of the adjacent axial fans 110, with or without the stationary blade 111 therebetween, to rotate in opposite directions as viewed from the axially upper side.

Other Embodiments

Each of the embodiments described above represents one aspect of the invention, to which the invention is not limited, and the invention is modifiable within the scope thereof. The material of the housings 4, 104, for example, may be any of various resin or a die-cast aluminum product. Also, the protrusions 44, 144 and the notches 45, 145 may take any arbitrary shape as required.

Further, the cylindrical portions 41, 141 are not required to have a completely cylindrical inner peripheral surface, but may have a venturi-shaped inner peripheral surface with the diameter changing in the direction along the rotational axis of the impeller, or a wide tapered opening.

Also, the rotational axis of the impeller and the center axis of the housing are not required to coincide with each other but may be displaced from each other.

What is claimed is:

1. A blower comprising:

a plurality of housings including at least an upper housing and a lower housing, each of the housings having a plurality of blades arranged about an axis; wherein the upper housing includes a flat lower surface and a lower twist-locking portion, and the lower housing includes a flat upper surface and an upper twist-locking portion;

when the flat lower surface engages the flat upper surface, and the lower housing is turned about a center axis by a rotational angle with respect to the upper housing, the lower twist-locking portion frictionally engages the upper twist-locking portion so as to restrict movement of the upper housing with respect to the lower housing in axial and circumferential directions; and each of the lower twist-locking portion and the upper twist-locking portion is arranged along at least one outermost edge of a corner of the upper housing and the lower housing, respectively, such that when the lower twist-locking portion engages the upper twist-locking portion in the circumferential direction each of the outermost edge of the lower twist-locking portion and the outermost edge of the upper twist-locking portion define a portion of a continuous contour in the circumferential direction.

2. The blower according to claim 1, wherein the lower twist-locking portion includes a lower housing stopper extending to the outermost edge of the corner of the upper housing and the upper twist-locking portion includes an upper housing stopper extending to the outermost edge of the corner of the lower housing, and when the lower housing is turned about the center axis by the rotational angle, the lower housing stopper comes into contact with the upper housing stopper.

3. The blower according to claim 2, wherein, when the lower housing is turned about the center axis by the rotational angle and the lower housing stopper comes into contact with the upper housing stopper, the upper and lower housings have a continuous contour in the circumferential direction.

4. The blower according to claim 2, wherein a contacting area of the upper and lower housing stoppers is flat, and the flat contacting area has a predetermined angle with respect to the axis of the plurality of blades.

5. The blower according to claim 1, wherein the center axis coincides with the axis of the plurality of blades.

6. The blower according to claim 1, further comprising at least one additional housing attached to one of the upper housing and the lower housing, wherein the at least one additional housing includes a plurality of blades arranged about an axis.

7. The blower according to claim 1, wherein one of the upper and lower housings includes a radial recess, the other of the upper and lower housings includes a radial protrusion, and when the lower housing is turned by the rotational angle, the radial recess engages the radial protrusion so that the upper and lower housings are prevented from being separated from each other in the axial direction.

8. The blower according to claim 7, wherein an axial width of the radial recess and an axial width of the radial protrusion are substantially equal to each other.

9. The blower according to claim 1, wherein one of the upper and lower housings includes an axial recess, the other of the upper and lower housings includes an axial protrusion, and when the lower housing is turned by the rotational angle, the axial recess engages the axial protrusion so that the upper and lower housings are prevented from being separated from each other in the circumferential direction.

10. The blower according to claim 1, wherein at least one of the housings includes a stationary vane.

11. The blower according to claim 1, wherein at least one of the housings includes a fan.

12. The blower according to claim 1, wherein the upper housing is substantially the same as the lower housing.

13. The blower according to claim 1, wherein the lower twist-locking portion and the upper twist-locking portion have complementary shapes such that no air leaks from between the housings.

14. A blower comprising:

a plurality of housings including at least an upper housing and a lower housing, each of the housings having a plurality of blades arranged about an axis; wherein each of the housings includes a cylindrical portion, an opening arranged at each end of the cylindrical portion, and a plurality of flanges arranged radially outward of the cylindrical portion and a flat portion arranged on each of the flanges;

the upper housing includes a flat lower surface and a lower twist-locking portion provided in at least one of the flanges of the upper housing;

the lower housing includes a flat upper surface and an upper twist-locking portion provided in at least one of the flanges of the lower housing;

when the flat lower surface engages the flat upper surface, and the lower housing is turned about a center axis by a rotational angle in a first circumferential direction with respect to the upper housing, the lower twist-locking portion frictionally engages the upper twist-locking portion so as to prevent further movement of the upper housing with respect to the lower housing in the first circumferential direction and to prevent movement of the upper housing with respect to the lower housing in an axial direction; and when the lower housing is turned about the center axis in a second circumferential direction, opposite to the first circumferential direction, the lower twist-locking portion is disengaged from the upper twist-locking portion so as to permit the upper housing to be disassembled from the lower housing.

15. The blower according to claim 14, wherein an outer surface of the plurality of flanges is flush with an outer surface of the upper and lower twist-locking portions.

16. The blower according to claim 14, wherein a contacting area of each of the upper and lower housing twist-locking portions is flat and extends to an outermost edge of the lower housing and the upper housing, respectively, and the flat contacting areas are substantially perpendicular to the circumferential direction.

17. The blower according to claim 14, wherein one of the upper and lower housings includes a radial recess, the other of the upper and lower housings includes a radial protrusion, and when the lower housing is turned by the rotational angle, the radial recess engages the radial protrusion so that the upper and lower housings are prevented from being separated from each other in the axial direction.

18. The blower according to claim 14, wherein an axial width of the radial recess and an axial width of the radial protrusion are substantially equal to each other.

19. The blower according to claim 14, wherein at least one of the housings includes a stationary vane.

20. The blower according to claim 14, wherein the lower twist-locking portion and the upper twist-locking portion have complementary shapes such that no air leaks from between the housings.

* * * * *